United States Patent [19]

Uppal

[11] 4,040,439

[45] Aug. 9, 1977

[54] CUSHION VALVE ARRANGEMENT

[75] Inventor: Sohan Uppal, St. Louis Park, Minn.

[73] Assignee: Eaton Corporation, Cleveland, Ohio

[21] Appl. No.: 671,480

[22] Filed: Mar. 29, 1976

[51] Int. Cl.[2] ..... F15B 15/18

[52] U.S. Cl. ..... 137/115; 60/468; 91/451

[58] Field of Search ..... 60/468; 91/451; 137/115, 596.12; 417/299

[56] References Cited

U.S. PATENT DOCUMENTS

| | | | |
|---|---|---|---|
| 3,704,588 | 12/1972 | Trabbic | 417/299 X |
| 3,740,950 | 6/1973 | Polaski | 60/468 X |

*Primary Examiner*—Robert G. Nilson

*Attorney, Agent, or Firm*—Teagno & Toddy

[57] ABSTRACT

A cushion valve arrangement for reducing the rate of pressure build up and relieving pressure rebounds in a fluid conduit. The valve housing defines first and second fluid ports, a fluid passage communicating therebetween, and a cushion passage communicating between the fluid passage and the first and second fluid ports. A valve spool is disposed in the fluid passage and defines an axial bore, within which is disposed a slideable valve member. When the pressure and flow suddenly builds up, the valve member is biased to an open position permitting high pressure fluid to pass through the axial bore and radially out through a passage in the spool into the cushion passage from which the fluid flows to the other conduit. There is a dashpot on either end of the valve spool and the incoming high pressure fluid biases the valve spool away from its neutral position gradually reducing the flow area defined by the radial passage in the spool and the cushion passage, and thus gradually reducing the amount of fluid dumped to the other conduit. As the spool moves away from its neutral position, the opposite dashpot is reduced in volume, the excess fluid from that dashpot passing through a restricted orifice and out to the adjacent, lower pressure conduit. The size of the restricted orifice determines the rate at which the spool moves toward a position shutting off the flow into the cushion passage. This arrangement also provides a combination of crossover or double relief valving as well as anti-cavitation valving.

16 Claims, 7 Drawing Figures

CUSHION VALVE ARRANGEMENT

BACKGROUND OF THE DISCLOSURE

The present invention relates to a cushion valve arrangement for cushioning pressure surges in a hydraulic system.

Relief valves are commonly used in hydraulic systems where a fluid actuated device, such as a motor or piston-and-cylinder moves or controls or is subjected to a heavy load and may be started and stopped suddenly, thus developing a pressure surge in the system. More specifically, in the case of fluid-linked power steering systems, a sudden opening of the control valve may cause severe shocks to the system components. It is well known that a relief valve, when subjected to a sudden surge of pressure, will not react quickly enough, so that for a short interval of time the fluid pressure will rise above the relief valve setting. The resulting shock wave is often of sufficient magnitude to damage various components of the hydraulic circuit.

Typical relief valves which open when the system pressure rises above the pressure setting remain open as long as the system pressure is higher than the setting. While such a relief function is important, and may be an additional feature of the arrangement of the present invention, the invention is a true cushion valve. As used herein, the term "cushion" will be understood to mean reducing the pressure rise rate to minimize the effect of pressure surges at pressures below the relief valve setting. Although the cushion valve arrangement of the present invention may be used in any type of hydraulic system subjected to transient pressure shocks or pressure surges resulting from the starting, stopping or reversal of high inertia loads, it is especially adapted for use in fluid-linked power steering systems, and will be described in connection therewith.

Examples of prior art arrangements referred to incorrectly as "cushion" valves include U.S. Pat. Nos. 3,367,354 and 3,414,006.The former is illustrated in a steering system, but it is actually a surge relief valve, disposed upstream from the steering control valve, such that the entire system flow goes through the surge relief valve. In addition, the surge relief valve disclosed in the U.S. Pat. No. 3,367,354 is primarily a relief valve which opens in response to a relatively high pressure signal and thus, does not prevent pressure surges below the relief setting from damaging system components when the steering control valve is suddenly opened or suddenly closed. The surge relief valves taught in the cited prior art both have the additional disadvantage of being one-directional, i.e., they would not be operative if connected in parallel between the two conduits communicating between a steering control valve and a power steering cylinder. Also, valves of this type are not effective to prevent a jerky pressure rise below the relief setting, thus permitting jerky steering action.

Some of these disadvantages are overcome by the relief valve arrangement shown in U.S. Pat. No. 3,330,298, assigned to the assignee of the present invention. The valve arrangement of the cited patent still has the disadvantage of the entire system flow passing through the valve. Furthermore, because the valving arrangement utilized to relieve pressure surges is duplicated for each direction of operation, the overall valve has an excessive number of moving parts, valve members, valve seats, springs, etc..

SUMMARY OF THE INVENTION

Accordingly, it is an object of the present invention to provide a cushion valve assembly for cushioning high pressure surges in a hydraulic system, such as occur when a system control valve is opened or closed suddenly or a high inertia load is suddenly started, stopped, or reversed.

It is another object of the present invention to provide a cushion valve assembly which may be connected to parallel between two fluid conduits of a hydraulic system, in which either of the fluid conduits may be subjected to a high pressure surge, and only a portion of the system flow passes through the cushion valve.

It is a related object of the present invention to provide such a cushion valve assembly in which the cushion valve is effective to cushion not only an initial pressure surge in one of the fluid conduits, but also, an immediately subsequent pressure surge in the other fluid conduit, resulting from compression of the fluid in the other fluid conduit, such as may be caused by the momentum of the load.

It is a further object of the present invention to provide a cushion valve configuration in which the pressurized fluid relieved during a high pressure surge may be ported to the low pressure side of the system to further aid in cushioning the pressure surge, or may be ported to tank.

It is still another object of the present invention to provide such a cushion valve arrangement which includes a subsystem relief valve for each direction of operation, as well as anti-cavitation capability to prevent cavitation on the low pressure side of the system.

The above and other objects of the present invention are accomplished by the provision of a cushion valve for cushioning a high pressure surge in a first fluid conduit and porting the excess fluid to a second fluid conduit. The cushion valve comprises a valve body defining first and second ports for connection to the first and second fluid conduits, respectively. The valve body defines a valve bore communicating between the first and second ports and a cushion passage communicating between the valve bore and the second port. A first valve means is disposed in the valve bore and normally biased to prevent fluid flow from the first port to the cushion passage, and being movable, in response to a high pressure surge, to an open position permitting flow from the first port to the cushion passage. A second valve means is normally disposed in a neutral position to permit fluid flow from the first port to the cushion passage while the first valve means is in its open position. The second valve means and the valve body define a dashpot in fluid communication with the second port, and means is provided for communicating a high pressure surge in the first port to bias the second valve means away from its neutral position. Such movement of the second valve means reduces the volume of the dashpot, gradually reducing the flow area between the first port and the cushion passage, as fluid flows from the dashpot.

In accordance with another aspect of the present invention, there is another dashpot at the opposite end of the second valve means, and the first and second valve means are configured such that a high pressure surge at the second port will cause the excess fluid to be ported to the first port in a manner exactly the reverse of that previously described.

Figure 1:
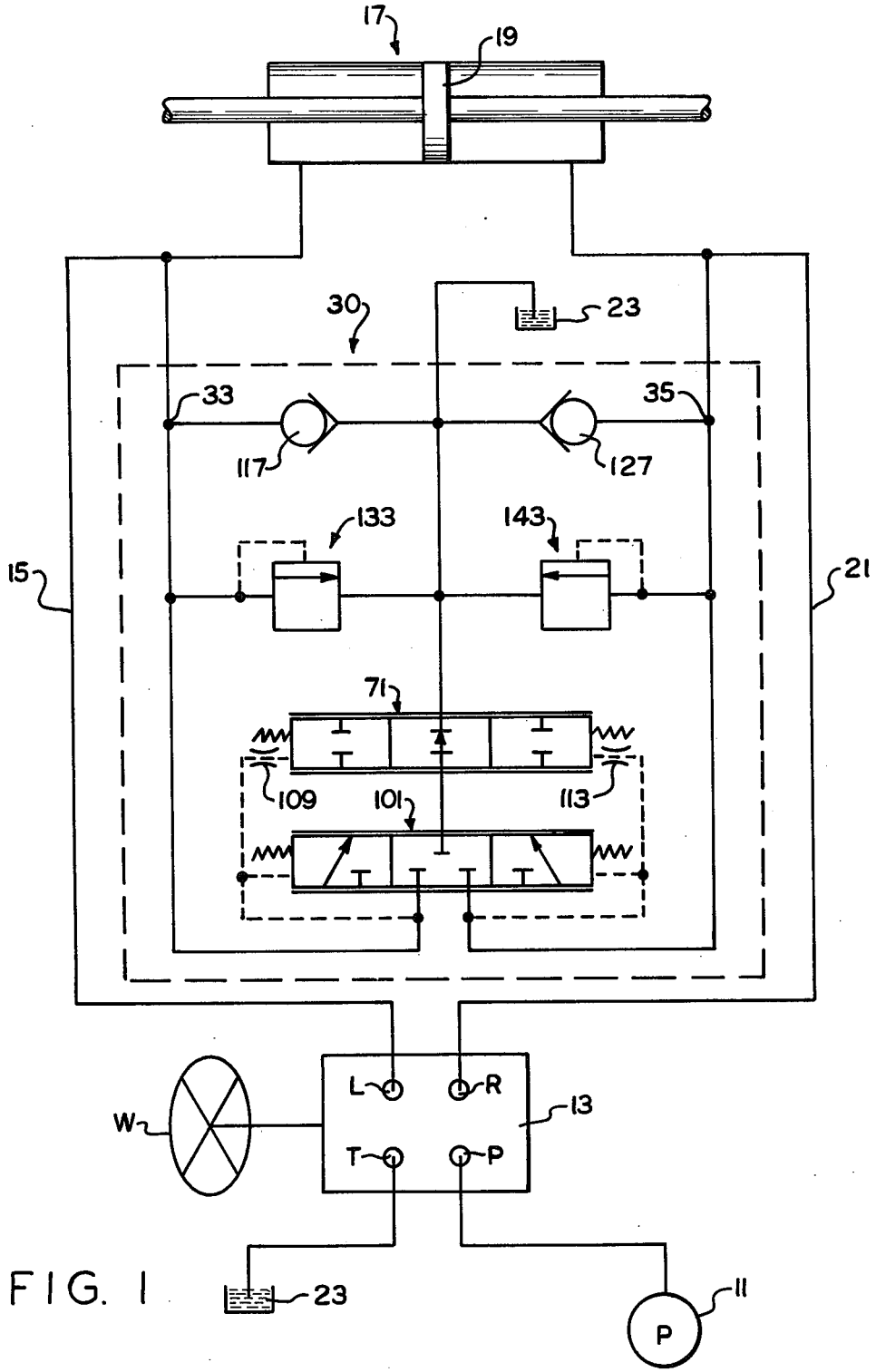
FIG. 1 is a schematic of a fluid-linked power steering system utilizing the cushion valve of the present invention.

DESCRIPTION OF THE PREFERRED EMBODIMENT:

Referring now to the drawings, which are not intended to limit the present invention, FIG. 1 illustrates schematically a fluid-linked power steering system in which a hydraulic pump 11 provides pressurized fluid to a steering control unit 13 at its pressure port P. Rotation of the steering wheel W actuates valving within the steering control valve 13 to provide pressurized fluid to either the left steering port L or the right steering port R. For purposes of all subsequent description, it will be assumed that steering wheel W has been rotated in such a direction to achieve a left turn.

The high pressure fluid is communicated from the left steering port L, by means of a conduit 15 to the left end of a steering cylinder 17 to move a piston 19 to the right in FIG. 1. The fluid displaced from the left end of the steering cylinder 17 is communicated by means of a conduit 21 back to the right steering port R of the steering control valve 13, from where the return fluid leaves the valve 13 at a tank port T and flows to a reservoir 23.

Connected in parallel between fluid conduits 15 and 21 is a cushion valve, generally designated 30, made in accordance with the teachings of the present invention. A detailed description of the cushion valve 30 will be made with reference to FIGS. 2 through 5, but it will be appreciated that a more thorough understanding of the cushion valve 30 may be gained by simultaneous reference to the schematic shown in FIG. 1.

Figure 2:
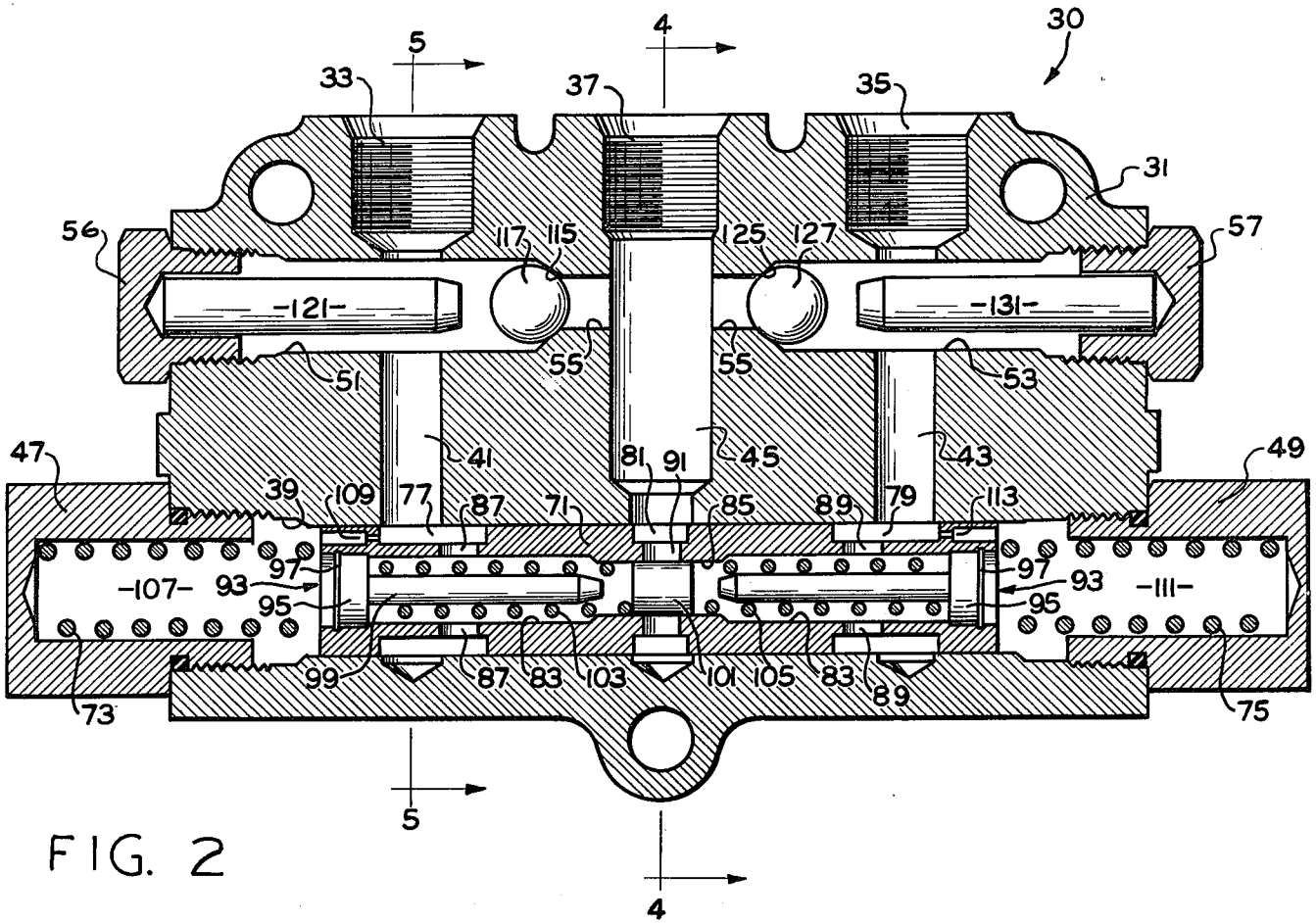
FIG. 2 is an axial cross-section of the cushion valve of the present invention, showing the condition of the valve when it is subjected to equal fluid pressures.

Referring now to FIG. 2, the cushion valve 30 comprises a valve body 31 which defines a left fluid port 33, a right fluid port 35, and a tank port, or return port 37. The valve body 31 further defines a main valve bore 39 which communicates with the left fluid port 33 by means of a passage 41, and with the right fluid port 35, by means of a passage 43. The tank port 37 communicates with the valve bore 39 by means of a passage 45. The valve bore 39 has its ends closed by means of a pair of plugs 47 and 49 which are in threaded engagement with the valve body 31.

Figure 4:
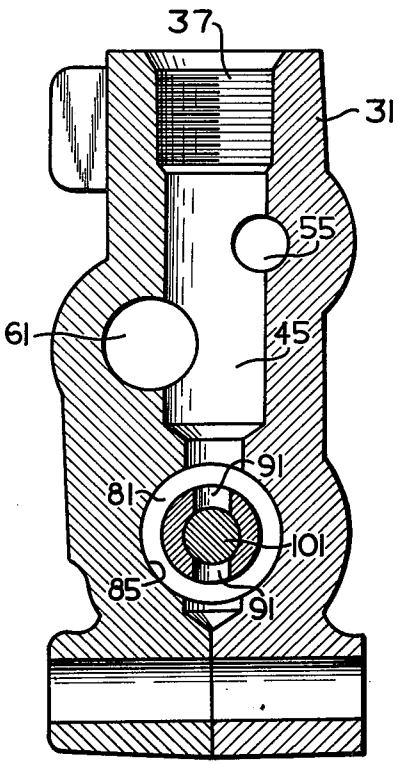
FIG. 4 is a transverse cross-section taken on line 4—4 of FIG. 2.

The valve body 31 defines a pair of passages 51 and 53 which are interconnected by means of a smaller passage 55 which, as may best be seen in FIG. 4, intersects passage 45. The ends of passages 51 and 53 are closed by means of plug members 56 and 57, respectively, each of which is in threaded engagement with the valve body 31.

Figure 3:
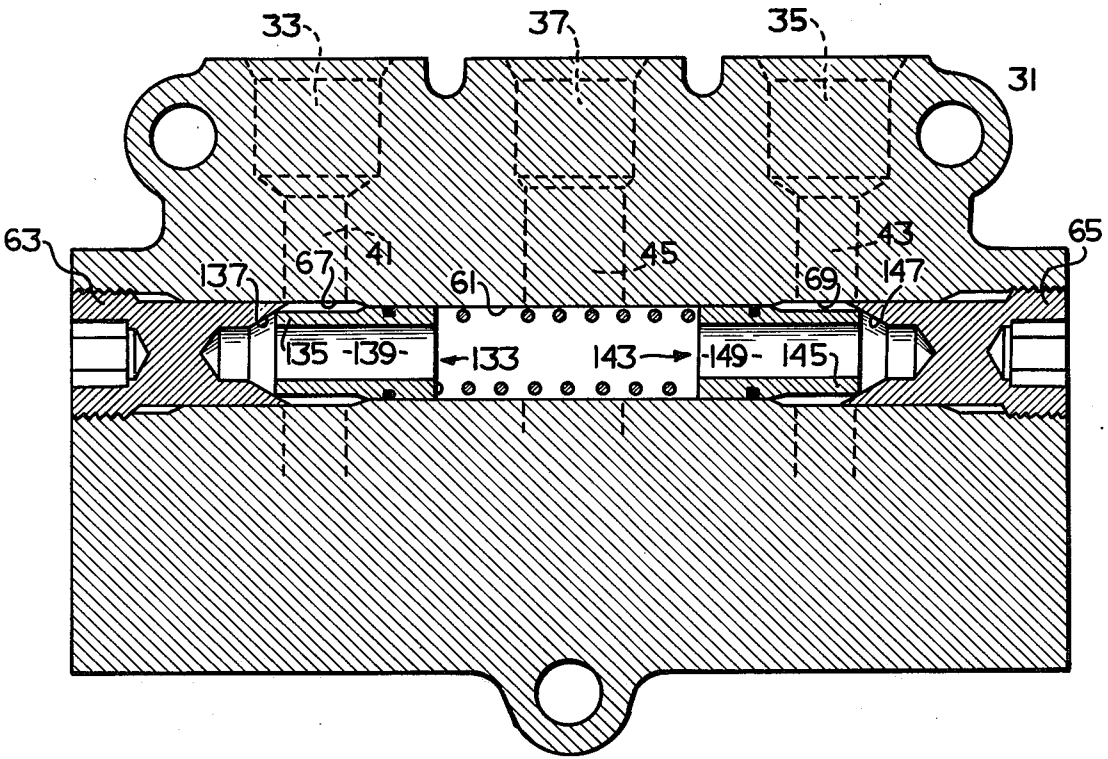
FIG. 3 is another axial cross-section of the cushion valve of the present invention, taken on a plane different than that of FIG. 2.
Figure 5:
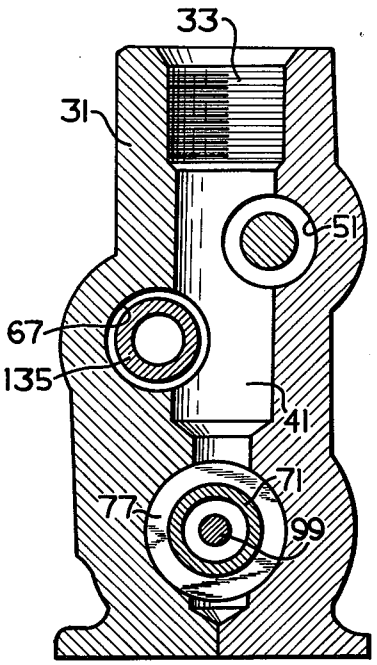
FIG. 5 is a transverse cross-section taken on line 5—5 of FIG. 2.

Referring now to FIG. 3, in conjunction with FIGS. 2, 4 and 5, it may be seen that the valve body 31 defines a passage 61 which intersects passage 45 opposite the intersection of passages 45 and 55 (see FIG. 4). Passage 61 has its ends closed by means of a pair of plug members 63 and 65, which are in threaded engagement with the valve body 31. It should be noted that FIG. 3 illustrates in dotted form the ports 33, 35, and 37, as well as the passages 41, 43 and 45, to show the relative position of those ports and passages to passage 61. The passage 61 includes an enlarged passage portion 67 in open communication with passage 41 and an enlarged passage portion 69 in open communication with passage 43.

Referring again to FIG. 2, there is disposed within the valve bore 39 a valve spool 71, axially slidable within the bore 39 and normally biased to its neutral position shown in FIG. 2, partly by means of a pair of compression springs 73 and 75. The valve spool 71 defines an annular groove 77 in fluid communication with passage 41, an annular groove 79 in fluid communication with passage 43, and an annular groove 81 in fluid communication with passage 45. The valve spool 71 further defines an axial bore 83, including a centrally disposed bore portion 85 of reduced diameter.

Communicating between the axial bore 83 and the annular groove 77 is a plurality of radial passages 87; communicating between the axial bore 83 and the annular groove 79 is a plurality of radial passages 89; and communicating between the reduced bore portion 85 and the annular groove 81 is a plurality of radial passages 91. At each end of valve spool 71 is a stop assembly 93, including an annular member 95 retained within axial bore 83 by means of a retainer member 97, and a spring support member 99 which, in the subject embodiment, is formed integrally with the annular member 95.

Disposed within the bore portion 85 is a cylindrical valve member 101 which is shown in FIG. 2 in its normal, closed position, and is biased to the closed position by means of a pair of compression springs 103 and 105. It will be appreciated that the springs 103 and 105 preferably exert substantially equal biasing forces on the valve member 101 and therefore, the valve member 101 will be in its normal, centrally disposed position shown in FIG. 2 only if the fluid pressures acting on the opposite sides of valve member 101 are substantially equal, which requires that the pressures at fluid ports 33 and 35 must be substantially equal.

The valve bore 39 cooperates with plug 47 and the left end of valve spool 71 to define a dashpot 107 which is in fluid communication with annular groove 77 by means of an orifice 109. Similarly, the valve bore 39 cooperates with the plug 49 and the right end of valve spool 71 to define a dashpot 111 which is in fluid communication with the annular groove 79 by means of an orifice 113. The function of the dashpots 107 and 111 and orifices 109 and 113 will be described in greater detail subsequently.

Referring now to the upper part of FIG. 2, it will be seen that the passages 51 and 55 are joined by a surface which provides a valve seat 115 against which a ball check valve 117 is biased by the force of fluid in the fluid port 33 and the passage 41. Movement of the ball valve 117 is limited by a support 121 fitted within a bore defined by the plug 55. Similarly, passages 53 and 55 are joined by a surface which defines a valve seat 125, against which a ball check valve 127 is biased by fluid in the port 35 and passage 43, with the movement of the ball valve 127 being limited by a support 131, fitted within a bore defined by the plug 57.

Referring again to FIG. 3, there is a relief valve member 133 disposed within passage 61, and having a portion 135 of reduced diameter disposed within enlarged passage portion 67 to define an annular chamber therebetween, and a differential area. The plug 63 defines a generally conical seat surface 137 against which the relief member 133 is seated in its normally closed position shown in FIG. 3. The relief valve member 133 has a bore 139 in continuous fluid communication with passage 61, and in fluid communication with the annular chamber defined by passage portion 67, when the valve member 133 is unseated from seat surface 137. Typically, the setting for the relief valve member 133 will be in the range of about 1,000 to about 3,000 psi; in the subject embodiment the setting is about 2,000 psi.

Similarly, there is a relief valve member 143 disposed within the opposite end of passage 61 and having a portion of reduced diameter 145 disposed within enlarged passage portion 69 to define an annular fluid chamber and a differential area. Plug 65 defines a conical seat surface 147 against which the relief valve member 143 is seated in its normally closed position. The relief valve member 143 has a bore 149 in continuous fluid communication with passage 61, and in fluid communication with the annular chamber defined by the passage portion 69 when the valve member 143 is unseated from seat surface 147. Because the relief valve members 133 and 143 are subjected to the fluid pressure in passages 41 and 43, respectively, they serve as the relief valves for the steering cylinders as will be described subsequently. The pressure setting of the relief valve members 133 and 143 may be adjusted by means of the threaded plug members 63 and 65 respectively, as is well known in the art.

OPERATION

As was noted earlier, the discussion relating to the operation of the cushion valve of the present invention will be based on the assumption that pressurized fluid flows from the left steering port L through the fluid conduit 15 to the left end of the steering cylinder 17, and low pressure return fluid flows through fluid conduit 21 to the right steering port R. Thus, the cushion valve 30 will sense a pressure surge or pressure rise in fluid port 33, while fluid port 35 will remain at approximately return pressure. Before describing the details of the operation, it should be noted that when the cushion valve 30 is utilized with the steering cylinder having equal fluid displacements in either direction, or with some other type of fluid motor having equal fluid displacements in either direction, the return port 37 may be plugged, rather than being connected to the fluid reservoir 23 as is shown schematically in FIG. 1. The same is true when there is no need for anti-cavitation protection in the event of overrunning loads.

For the purpose of explaining the operation of this valve, it may be assumed that the steering control valve 13 is initially in the neutral position and the fluid ports 33 and 35 are at substantially the same pressure (approximately cylinder pressure) and the valve spool 71 and valve member 101 are in their central positions. When the steering control valve 13 is suddenly opened, the fluid pressure in fluid port 33 begins to rise above return pressure and this rising pressure is present in passage 41, annular groove 77, radial passages 87, and axial bore 83. Thus, the rising pressure exerts a biasing force against the left end of valve member 101 which begins to move valve member 101 toward the right in FIG. 2. It is an important feature of the present invention that the biasing means (springs 103 and 105) which maintain the valve member 101 in its normally closed position exert a sufficiently small biasing force that the valve member 101 is biased to the right in FIG. 2 when the fluid pressure in fluid port 33 is still at a relatively low pressure level. For example, in the subject embodiment, the compression springs 103 and 105 have a spring rate such that a fluid pressure of only about 60 psi is sufficient to force the valve member 101 to the right, in engagement with the spring support 99, which acts as a stop for the movement of the valve member 101. With the valve member 101 biased to the right, the fluid in axial bore 83 and bore portion 85 flows through radial passages 91 and into annular groove 81, from where it enters passage 45. Because the fluid pressure now in passage 45 is greater than return pressure, if fluid port 37 is plugged, the fluid acts on the ball check valve 127, overcoming the biasing force to move the valve 127 away from its valve seat 125 and permit the pressurized fluid in passage 45 and passage 55 to enter passage 53, then into passage 43, and finally out fluid port 35 and into fluid conduit 21 (see FIG. 1). This flow of pressurized fluid into fluid conduit 21 causes a small increase in pressure acting on the right side of the piston 19, although the pressure increase is substantially less than that acting on the left side of the piston 19, and this small pressure rise on the right side of the piston 19 further serves to cushion the effect of the rising pressure in fluid conduit 15.

Referring again to FIG. 2, it will be appreciated that as the fluid pressure in passage 41 begins to build up, the pressure rise is communicated through orifice 109 to the dashpot 107. This pressure rise in the dashpot 107 exert a biasing force on the valve spool 71 which begins to move the valve spool 71 to the right (see FIG. 6). As was the case with the valve member 101, it is a feature of the present invention that the movement of the valve spool 71 should begin to occur at relatively low pressure levels and that, in order to achieve this objective, the biasing forces exerted by the springs 73 and 75 on the valve spool 71 must be somewhat lower than that required for the valve member 101. In the subject embodiment, a fluid pressure in dashpot 107 of about 60 psi greater than the fluid pressure in the dashpot 111 is sufficient to begin biasing the valve spool 71 to the right as shown in FIG. 6.

As the valve spool 71 is biased toward the right, the volume of the dashpot 111 decreases, and the excess fluid in the dashpot 111 passes through the orifice 113, into the annular groove 79, up through the passage 43 and out fluid port 35. It may be seen by comparing FIGS. 2 and 6 that as the valve spool 71 moves toward the right, the fluid flow area between the annular groove 81 and the passage 45 begins to decrease almost immediately as the rightward movement of the valve spool 71 commences. In addition, the fluid flow area between the bore portion 85 and the radial passages 91 may also be a limiting factor, depending upon the relative sizes of the various bores and passages.

Therefore, it is an important feature of the present invention that almost immediately as the pressure begins to rise above neutral pressure, the valve member 101 permits some of the pressurized fluid to be dumped to the return side of the circuit, and at the same time, the valve spool 71 is gradually being moved away from its neutral position so that the amount of fluid being dumped to the return side begins to decrease.

Figure 6:
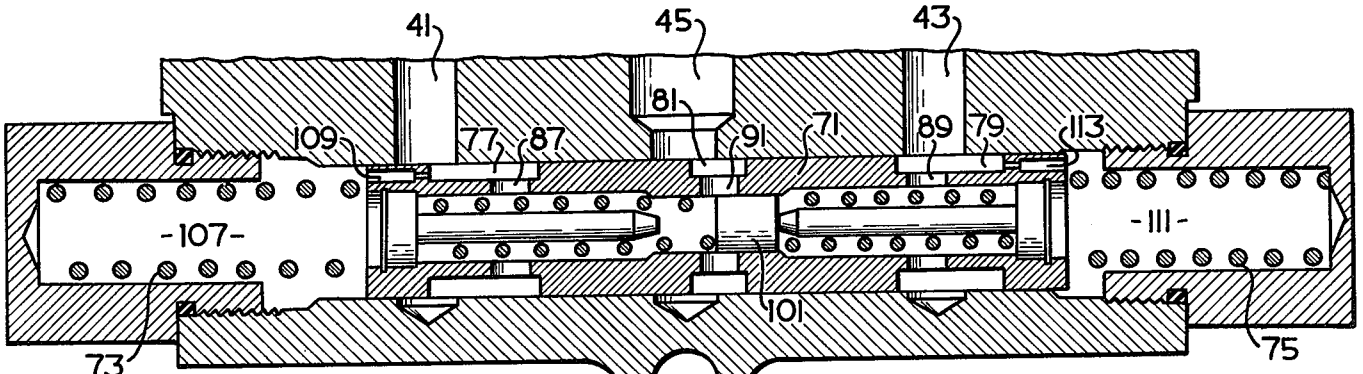
FIG. 6 is a fragmentary, axial cross-section, similar to FIG. 2, with the valve spool partially shifted.
Figure 7:
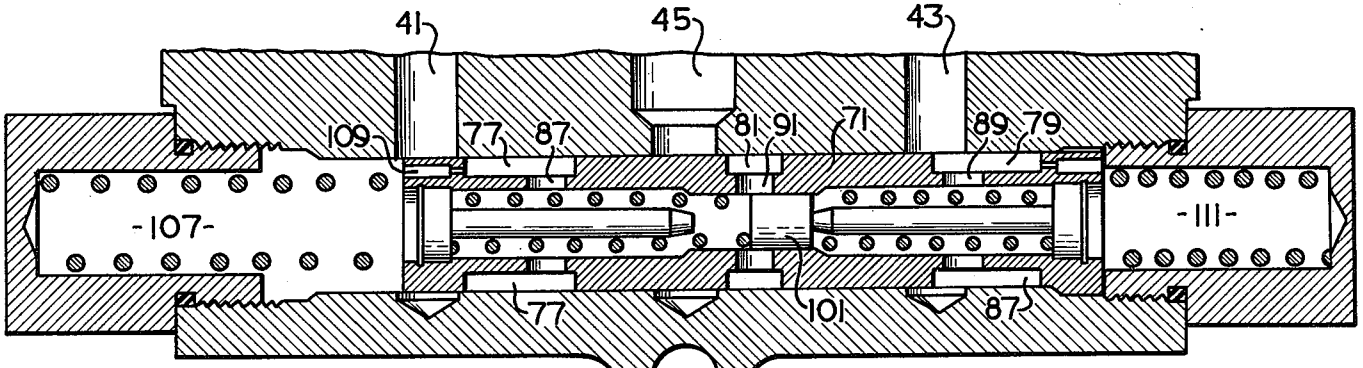
FIG. 7 is a fragmentary, axial cross-section, similar to FIGS. 2 and 6, with the valve spool fully shifted.

Referring now to FIG. 7, there is illustrated the condition of the cushion valve 30 when the flow pressure in the fluid port 33 has risen above that associated with the condition shown in FIG. 6. The rising pressure in passage 41 has been communicated through the orifice 109 into the dashpot 107, and when the pressure in the dashpot 107 has reached a sufficiently high level, the valve spool 71 is biased all the way to the right until the right end of the valve spool 71 engages the left end of the plug 49, thereby limiting the rightward movement of the valve spool 71. With the spool 71 in the position shown in FIG. 7, it may be seen that the pressurized fluid in the axial bore 83 and bore portion 85 is no longer communicated to the passage 45 because the annular groove 81 is axially displaced far enough that it is no longer in fluid communication with the passage 45. Therefore, when the cushion valve of the present invention reaches the condition illustrated in FIG. 7, there may or may not be any further pressure rise.

It should be understood that the "cushioning" effect to the cushion valve of the present invention is closely related to the amount of time between the initial commencement of pressure rise and the termination of cushioning or dumping of pressurized fluid to the fluid conduit 21 (the condition illustrated in FIG. 7). Because the "cushioning time" depends directly on the time it takes the valve spool 71 to move from the position shown in FIG. 2 to the position shown in FIG. 7, the ability to control this rate of movement of the spool 71, or correlate the rate of movement with the pressure rise rate, is, in effect, the ability to control the "cushioning time." Because the rate of movement of the valve spool 71 is directly controlled by the rate of pressure rise in the dashpot 107 and the rate of fluid leaving the dashpot 111, the rate of movement of the valve spool 71 is dependent upon the size of the orifice 109 permitting fluid to enter the dashpot 107 and the size of the orifice 113 permitting fluid to leave the dashpot 111.

Also, for a given orifice size, an increase in the pressure differential between the fluid ports 33 and 35 will reduce the "cushioning time." If, at the end of the cushioning time, the pressure at the fluid port 33 continues to rise, and reaches the pressure setting of the relief valve member 133, this fluid pressure will unseat the valve member 133 from the seat surface 137. The relieved fluid flows through the bore 139, into the passage 61 and out through passage 45 and fluid port 37 to the tank.

In the event of an overrunning load at anytime during the operation of a system utilizing the cushion valve 30 of the present invention, the ball check valves 117 and 127 can operate as anti-cavitation valves as follows. If the fluid pressure in conduit 21 drops below the normal return or tank pressure as a result of an overrunning load, the fluid in passage 45 (presumably at tank pressure with fluid port 37 connected to reservoir 23) moves the ball valve 127 away from the valve seat 125. When this occurs, the supply of fluid available in passage 45 at tank pressure flows from the fluid port 35 and maintains fluid conduit 21 at tank pressure also.

It should be apparent that, although the cushion valve of the present invention was described only in connection with a left-hand turn, the cushion valve 30 is bidirectional. Therefore, it is an important feature of the present invention that, when steering is terminated, if the momentum of the vehicle exerts a force on the piston 19, tending to move it further in the same direction it was already moving, the cushion valve will prevent a "rebound" shock. In the situation described, the low pressure fluid in conduit 21 would be compressed, causing a pressure surge at fluid port 35 and in response to which the cushion valve 30 cushions the pressure build-up at fluid port 35 by just the opposite sequence of operation as described previously.

I claim:

1. A valve assembly adapted to be connected in parallel between first and second fluid conduits, the first fluid conduit communicating pressurized fluid to a fluid actuated device and the second fluid conduit communicating return fluid from the fluid actuated device, said valve assembly cushioning the rate of pressure rise of the pressurized fluid and comprising:

a. a valve body defining a first port for connection to the first fluid conduit, a second port for connection to the second fluid conduit, a spool bore in open communication with said first and second ports at first and second axially spaced-apart locations, and a cushion passage communicating with said first and second ports and with said spool bore at a third location disposed axially between said first and second locations;

b. a valve spool slidably disposed within said spool bore and having a central position therein, said valve spool defining an axial bore, first and second passage means communicating between said axial bore and said first and second ports, respectively, and third passage means communicating between said axial bore and said cushion passage when said valve spool is in said central position;

c. a valve piston slidably disposed within said axial bore and biased toward a neutral position blocking fluid communication between said axial bore and said third passage means when said first and second ports are subjected to less than a minimal pressure differential, said valve piston being movable to a second position, relative to said valve spool, permitting fluid from said first port to flow to said cushion passage, then to said second port when fluid pressure in said first port exceeds fluid pressure in said second port by at least said minimal pressure differential;

d. said valve spool, said valve body and said spool bore defining first and second dashpots and first and second orifices, said first orifice communicating between said first passage means and said first dashpot, said second orifice communicating between said second passage means and said second dashpot, an increase in fluid pressure in said first port causing an increase in pressure in said first dashpot, moving said valve spool in a direction to cause fluid to flow from said second dashpot to said second passage means, gradually reducing to zero the flow area defined by said third passage means and said cushion passage.

2. A valve assembly as claimed in claim 1 wherein said valve piston is biased toward said neutral position by first and second biasing means exerting opposite and approximately equal forces on said valve piston.

3. A valve assembly as claimed in claim 2 including a first relief valve means in fluid communication with said first port, said first relief valve means being operable to relieve fluid pressure in excess of a predetermined pressure limit, said predetermined pressure limit being in the range of about 1,000 psi to about 3,000 psi.

4. A valve assembly as claimed in claim 3 wherein said minimal pressure differential necessary to move said valve piston from said neutral position to said second position is less than about 200 psi.

5. A valve assembly as claimed in claim 3 including a second relief valve means in fluid communication with said second port, said second relief valve means being operable to relieve fluid pressure in excess of said predetermined pressure limit.

6. A cushion valve for cushioning a high pressure surge in a first fluid conduit and porting fluid to a second fluid conduit comprising:

a. a valve body defining first and second ports for connection to the first and second fluid conduits, respectively;

b. said valve body further defining a valve bore in communication with said first and second ports and a cushion passage communicating between said valve bore and said second port;

c. first valve means disposed in said valve bore and normally biased to prevent fluid flow from said first port to said cushion passage, said first valve means being movable, in response to a pressure surge, to an open position permitting flow from said first port to said cushion passage;

d. second valve means normally disposed in a neutral position to permit fluid flow from said first port to said cushion passage, while said first valve means is in said open position;

e. said second valve means and said valve body defining a dashpot in fluid communication with one of said second port and said cushion passage; and f. means for communicating a pressure surge in said first port to bias said second valve means away from said neutral position, to reduce the volume of said dashpot, gradually reducing the flow area between said first port and said cushion passage as fluid flows from said dashpot.

7. A cushion valve assembly adapted to be connected between first and second fluid conduits to cushion a pressure surge in either of said first and second fluid conduits, comprising:

a. housing means defining first and second fluid ports for connection to the first and second fluid conduits, respectively;

b. said housing means including means defining a fluid passage communicating between said first and second fluid ports, and means defining a cushion passage communicating between said fluid passage and said first fluid port and between said fluid passage and said second fluid port;

first valve means disposed within said housing means and normally biased to prevent fluid flow through said fluid passage, said first valve means being movable to an open condition, in response to a pressure surge in one of said first and second fluid ports, to permit fluid flow from said one fluid port to said cushion passage and to the other of said first and second fluid ports;

d. second valve means normally disposed in a neutral position to permit fluid flow from one of said fluid ports to said cushion passage while said first valve means is in said open condition;

e. said second valve means being operable, in response to a pressure surge in one of said first and second fluid ports, to move from said neutral position to one of a first and second position, gradually reducing the fluid flow from said one fluid port, through said cushion passage, to the other of said first and second fluid ports; and f. said second valve means comprising a valve spool disposed in said fluid passage and having first and second ends, said housing means and said valve spool cooperating to define a first orifice communicating between said first fluid port and said first end and a second orifice communicating between said second fluid port and said second end.

8. A cushion valve assembly as claimed in claim 7 wherein said movement of said second valve means from said neutral position is caused by a pressure surge in one of said first and second fluid ports being communicated through said one of said first and second orifices to exert a biasing force against said one of said first and second ends.

9. A cushion valve assembly as claimed in claim 8 wherein said housing means and said first and second ends of said valve spool define, respectively, first and second dashpots, and said movement of said second valve means in response to a pressure surge in said one fluid port causes a decrease in volume of the other of said first and second dashpots, excess fluid therefrom flowing through said other of said first and second orifices to said other of said first and second fluid ports.

10. A cushion valve assembly as claimed in claim 7 wherein said cushion passage includes a main passage portion communicating with said fluid passage, a first passage portion communicating between said first fluid port and said main passage portion and a second passage portion communicating between said second fluid port and said main passage portion.

11. A cushion valve assembly as claimed in claim 10 including a first check valve means disposed in said first passage portion to permit fluid flow from said main passage portion to said first fluid port, and a second check valve means disposed in said second passage portion to permit fluid flow from said main passage portion to said second fluid port.

12. A cushion valve assembly as claimed in claim 11 wherein said main passage portion communicates with a return port adapted to be connected to a fluid reservoir, said first and second check valve means are biased closed by a sufficiently small biasing force to permit fluid from said main passage portion to overcome said biasing force, when fluid pressure in one of said first and second fluid ports is below a minimum pressure, and flow to said one fluid port, preventing cavitation therein.

13. A cushion valve assembly as claimed in claim 10 including first relief valve means disposed to relieve fluid in said first fluid port, above a maximum pressure, to said main passage portion and second relief valve means disposed to relieve fluid in said second fluid port, above said maximum pressure, to said main passage portion.

14. A cushion valve assembly as claimed in claim 7 wherein said valve spool defines an axial bore, first and second radial passages communicating between said axial bore and said first and second fluid ports, respectively, and a third radial passage communicating between said axial bore and said cushion passage.

15. A cushion valve assembly as claimed in claim 14 wherein said first valve means comprises a valve member disposed in said axial bore and being normally biased to prevent fluid flow from said axial bore to said third radial passage, the flow area defined by said third radial passage and said cushion passage being reduced by said movement of said valve spool from said neutral position.

16. A cushion valve adapted to be connected between first and second fluid conduits that are in fluid communication with a fluid actuated device, said valve comprising:

a. a valve body defining a first port adapted for fluid communication with said first fluid conduit, a second port adapted for fluid communication with said second fluid conduit, an axially extending spool bore in open fluid communication with said first and second ports at first and second axially spaced locations, and a cushion passage communicating with said second port and with said spool bore at a third location disposed axially relative to said first and second locations;

b. a valve spool slidably disposed within said spool bore and having a central position and an axially disposed position, said valve spool defining an axially extending piston bore in open fluid communication with said spool bore at axially disposed locations and having first and second ends respectively in fluid communication with said first and second ports;

c. means for providing open fluid communication between said spool bore and said cushion passage when said valve spool is in said central position, for restricting fluid communication between said spool bore and said cushion passage by an amount which is proportional to axial movement of said valve spool from said central position to said axially disposed position, and for blocking fluid communication between said spool bore and said cushion passage when said valve spool is in said axially disposed position;

d. means biasing said valve spool to said central position;

e. a valve piston slidably disposed within said piston bore and having a neutral position and an axially disposed position, said valve piston having first and second ends respectively in fluid communication with said first and second ports;

f. means for providing open fluid communication between said piston bore and said cushion passage when said valve piston is in said axially disposed position, for restricting fluid communication between said piston bore and said cushion passage by an amount which is proportional to axial movement of said valve piston from said axially disposed position to said neutral position, and for blocking fluid communication between said piston bore and said cushion passage when said valve piston is in said neutral position;

g. means biasing said valve piston to said neutral position; and h. a dashpot engaged with said valve spool to cushion movement of said valve spool away from said central position toward said axially disposed position.

* * * * *